US007994875B2

(12) United States Patent
Chen et al.

(10) Patent No.: US 7,994,875 B2
(45) Date of Patent: Aug. 9, 2011

(54) TRI-FREQUENCY DUPLEXER CIRCUIT AND MULTI-FREQUENCY DUPLEXER CIRCUIT

(75) Inventors: Fu-Chiarng Chen, Hsinchu (TW); Shi-Yung Wang, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 216 days.

(21) Appl. No.: 12/470,005

(22) Filed: May 21, 2009

(65) Prior Publication Data

US 2010/0283553 A1 Nov. 11, 2010

(30) Foreign Application Priority Data

May 5, 2009 (TW) ..... 98114912 A

(51) Int. Cl.
*H01P 5/12* (2006.01)

(52) U.S. Cl. ..... 333/126; 333/134

(58) Field of Classification Search ..... 333/126, 333/129, 132, 134, 204
See application file for complete search history.

(56) References Cited

U.S. PATENT DOCUMENTS

| | | | | |
|---|---|---|---|---|
| 4,910,481 | A * | 3/1990 | Sasaki et al. | 333/134 |
| 5,880,649 | A * | 3/1999 | Tai et al. | 333/132 |
| 6,621,376 | B2 * | 9/2003 | Liu et al. | 333/126 |
| 6,943,650 | B2 * | 9/2005 | Ramprasad et al. | 333/202 |
| 7,495,528 | B2 * | 2/2009 | Fukunaga | 333/132 |

OTHER PUBLICATIONS

Yang et al., "A novel two-layer compact electromagnetic bandgap (EBG) structure and its applications in microwave circuits", Science in China Series E: Technological Sciences, vol. 46, No. 4, Aug. 2003, pp. 439-447.*

Horii, "A Compact Band Elimination Filter Composed of a Mushroom Resonator Embedded in a Microstrip Line Substrate", Microwave Conference Proceedings, APMC 2005 Proceedings, Dec. 2005, pp. 1-4.*

Chen, Fu Chiarng, et al., "The multi-band EBG characteristic of the mushroom structure with the suspending microstrip line", Department of Communication Engineering, National Chiao Tung University, Hsinchu, Taiwan, R.O.C., Sep. 2008.

* cited by examiner

*Primary Examiner* — Seungsook Ham
(74) *Attorney, Agent, or Firm* — WPAT, P.C.; Anthony King

(57) ABSTRACT

The present invention discloses a tri-frequency duplexer circuit and multi-frequency duplexer circuit. The tri-frequency duplexer circuit comprises a microstrip line circuit, two first mushrooms, two second mushrooms and two third mushrooms. The microstrip line circuit comprises a first Input/Output (I/O) port, a second I/O port, a third I/O port and a fourth I/O port. The two first mushrooms are respectively disposed at transmission line paths between the first I/O port and the second I/O port and between the first I/O port and the third I/O port. The two second mushrooms are respectively disposed at transmission line paths between the first I/O port and the second I/O port and between the first I/O port and the fourth I/O port. The two third mushrooms are respectively disposed at transmission line paths between the first I/O port and the third I/O port and between the first I/O port and the fourth I/O port.

12 Claims, 13 Drawing Sheets

TRI-FREQUENCY DUPLEXER CIRCUIT AND MULTI-FREQUENCY DUPLEXER CIRCUIT

BACKGROUND OF THE INVENTION

1. Field of the Invention

The present invention relates to a tri-frequency duplexer circuit and multi-frequency duplexer circuit; in particular, the present invention relates to a tri-frequency duplexer circuit and multi-frequency duplexer circuit utilizing mushroom Electromagnetic Band Gap (EBG) frequency designs.

2. Description of Related Art

At present, system integration technologies have made huge contributions to the advancement of the wireless system, and wireless communication systems capable of integrating a variety of communication frequency specifications have especially become the focused issue recently as well. Therefore, the circuit design at the system integration end whose circuits enable good integration of various functions in accordance with different communication specifications is definitely one of the best technologies in such type of focused application fields.

Common circuit designs may include the duplexer, the diplexer and the triplexer. FIG. 1-*a* shows a duplexer, FIG. 1-*b* shows a diplexer, and FIG. 1-*c* shows a triplexer. Though conventional technologies can integrate different communication specifications, including the bi-directional communication in the duplexer 100, as well as the frequency classification function in the diplexer 101 and the triplexer 102, current microwave circuit at the integration end can nevertheless only achieve either bi-direction communication or frequency classification function. In other word, a bi-directional communication circuit is incapable of providing frequency classification function, while the circuit having frequency classification function does not provide bi-directional communication. The reasons for this dilemma found in the present microwave circuit lie in limitation of prior art design and use of non-comprehensive matching network. Consequently, seeking alternative design solutions to allow the microwave circuit at the integration end to simultaneously have bi-directional communication and frequency classification function will be helpful for the construction of future integrated communication systems.

SUMMARY OF THE INVENTION

In view of the aforementioned issues found in prior art, the objective of the present invention is to provide a tri-frequency duplexer circuit and multi-frequency duplexer circuit which simultaneously provides the bi-directional communication of a duplexer and the frequency classification function of a triplexer, so as to integrate signal reception and transfer operations of a communication system, enabling mutual data transmissions between different systems.

According to the objective of the present invention, herein a tri-frequency duplexer circuit is proposed, comprising a microstrip line circuit, two first mushrooms, two second mushrooms and two third mushrooms. The microstrip line circuit comprises a first Input/Output (I/O) port, a second I/O port, a third I/O port and a fourth I/O port. The two first mushrooms are respectively disposed at a transmission line path between the first I/O port and the second I/O port and a transmission line path between the first I/O port and the third I/O port. The two second mushrooms are respectively disposed at the transmission line path between the first I/O port and the second I/O port and a transmission line path between the first I/O port and the fourth I/O port. The two third mushrooms are respectively disposed at the transmission line path between the first I/O port and the third I/O port and the transmission line path between the first I/O port and the fourth I/O port.

Herein the Electromagnetic Band Gap (EBG) frequencies of the first mushroom, second mushroom and third mushroom may differ with each other.

According to a further objective of the present invention, herein a multi-frequency duplexer circuit is proposed. The multi-frequency duplexer circuit can be applicable for multi-frequency operations in N frequency bands, N being an integer greater than 1. The multi-frequency duplexer circuit comprises a microstrip line circuit and N mushroom sets. The microstrip line circuit further comprises a first Input/Output (I/O) port, N second I/O ports and N transmission line paths. The N transmission line paths are respectively connected to the first I/O port and the N second I/O ports. Wherein, the Mth second I/O port is used to input/output a signal of a frequency located within the Mth frequency band, M being an integer between 1 and N. For the N mushroom sets, each mushroom set comprises N−1 mushrooms, and the EBG frequencies of the mushrooms in the N mushroom sets respectively correspond to the N frequency bands. Wherein, the mushrooms of the Mth mushroom set are respectively disposed at the transmission line paths with an exception of the Mth transmission line path.

In summary, the tri-frequency duplexer circuit and multi-frequency duplexer circuit according to the present invention provides one or more following advantages:

(1) it allows to integrate simultaneously signal receptions and transfers of multiple communication systems, thereby enabling a mutual data transmission function among the multiple systems;

(2) it is capable of having the bi-directional communication of a duplexer and the frequency classification function of a triplexer at the same time;

(3) it eliminates possible requirement of complicated matching circuits by means of simple transmission line impedance matching.

BRIEF DESCRIPTION OF THE DRAWINGS

FIG. 1-*b* is a diagram of a prior art diplexer;

FIG. 1-*c* is a diagram of a prior art triplexer;

FIG. 3-*b* is an effectively equivalent circuit diagram of a mushroom in the tri-frequency duplexer circuit according to the present invention;

FIG. 3-*c* is an impedance diagram in the tri-frequency duplexer circuit according to the present invention in consideration of transmission line effect;

FIG. 5-*b* is a measurement diagram for the S parameter inputted from the second I/O port of the tri-frequency duplexer circuit according to the present invention;

FIG. 5-*c* is a measurement diagram for the S parameter inputted from the third I/O port of the tri-frequency duplexer circuit according to the present invention;

FIG. 5-*d* is a measurement diagram for the S parameter inputted from the fourth I/O port of the tri-frequency duplexer circuit according to the present invention.

DETAILED DESCRIPTION OF THE PREFERRED EMBODIMENTS

Figure 1A:
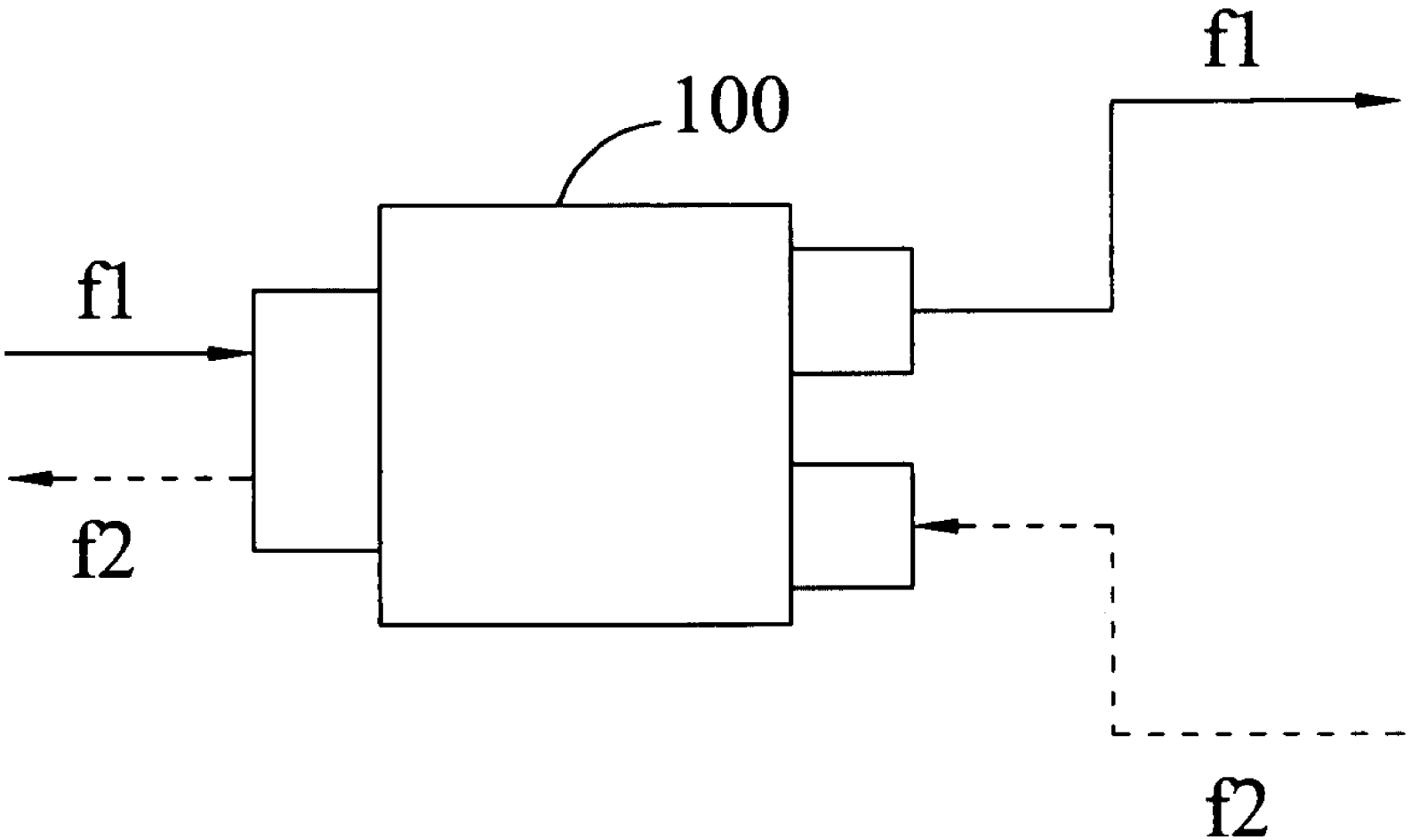
FIG.1a(PRIOR ART)
FIG. 1-*a* is a diagram of a prior art duplexer.
Figure 1B:
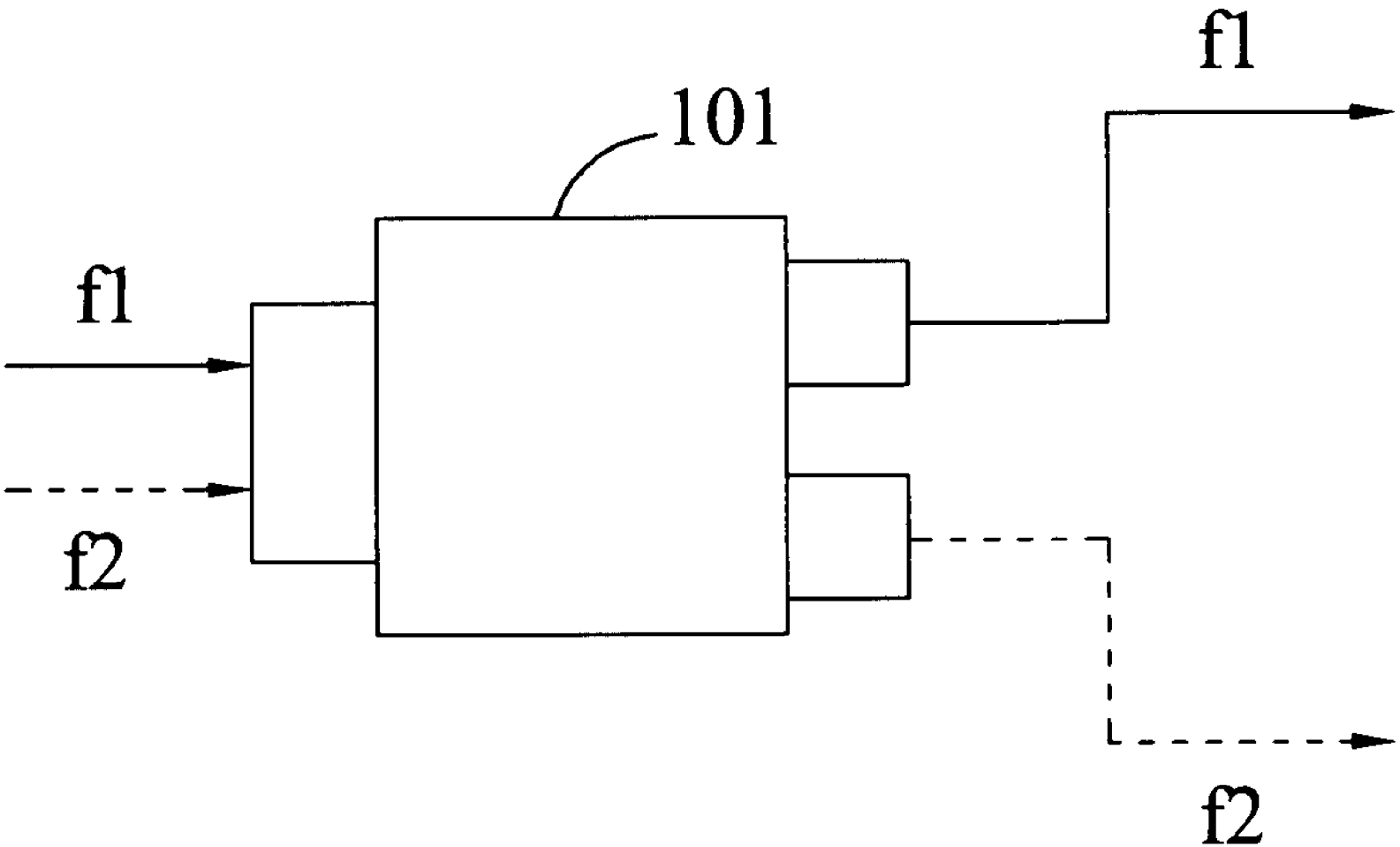
FIG.1b(PRIOR ART)
Figure 1C:
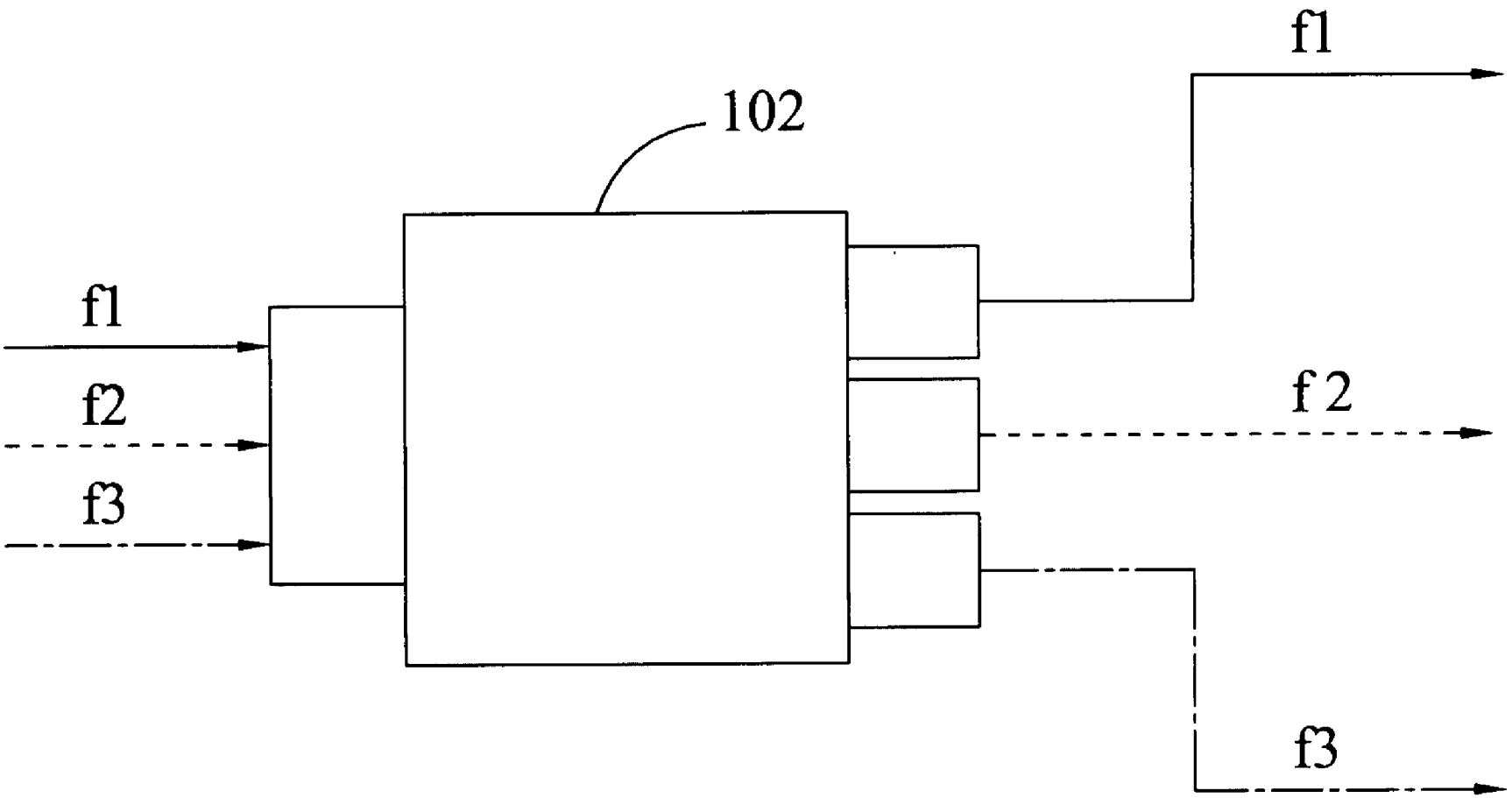
FIG.1c(PRIOR ART)
Figure 2:
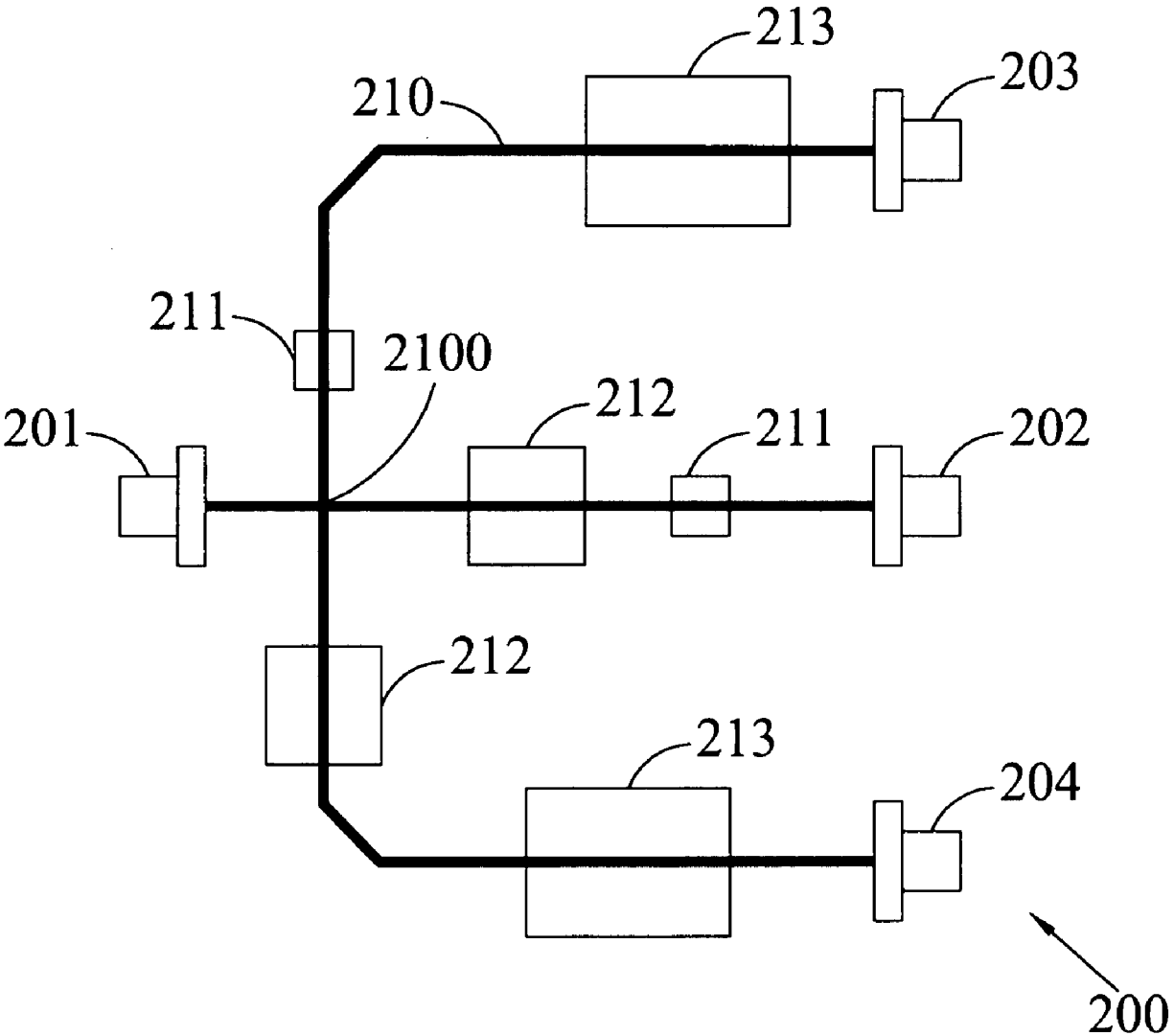
FIG. 2 is a diagram of a tri-frequency duplexer circuit according to the present invention.

Refer now to FIG. 2, wherein a diagram of a tri-frequency duplexer circuit according to the present invention is shown. In this Figure, the tri-frequency duplexer circuit 200 comprises a microstrip line circuit, two first mushrooms 211, two second mushrooms 212 and two third mushrooms 213. The microstrip line circuit 210 may have a first I/O port 201, a second I/O port 202, a third I/O port 203 and a fourth I/O port 204.

The first mushrooms 211 may be respectively placed at the transmission line path between the first I/O port 201 and the second I/O port 202 and the transmission line path between the first I/O port 201 and the third I/O port 203. The first mushrooms 211 may have a first Electromagnetic Band Gap (EBG) frequency, such that signals having the first EBG frequency can not pass through the first mushrooms 211.

The second mushrooms 212 may be respectively placed at the transmission line path between the first I/O port 201 and the second I/O port 202 and the transmission line path between the first I/O port 201 and the fourth I/O port 204. The second mushrooms 212 may have a second EBG frequency, such that signals having the second EBG frequency can not pass through the second mushrooms 212.

The third mushrooms 213 may be respectively placed at the transmission line path between the first I/O port 201 and the third I/O port 203 and the transmission line path between the first I/O port 201 and the fourth I/O port 204. The third mushrooms 213 may have a third EBG frequency, such that signals having the third EBG frequency can not pass through the third mushrooms 213.

Figure 3A:
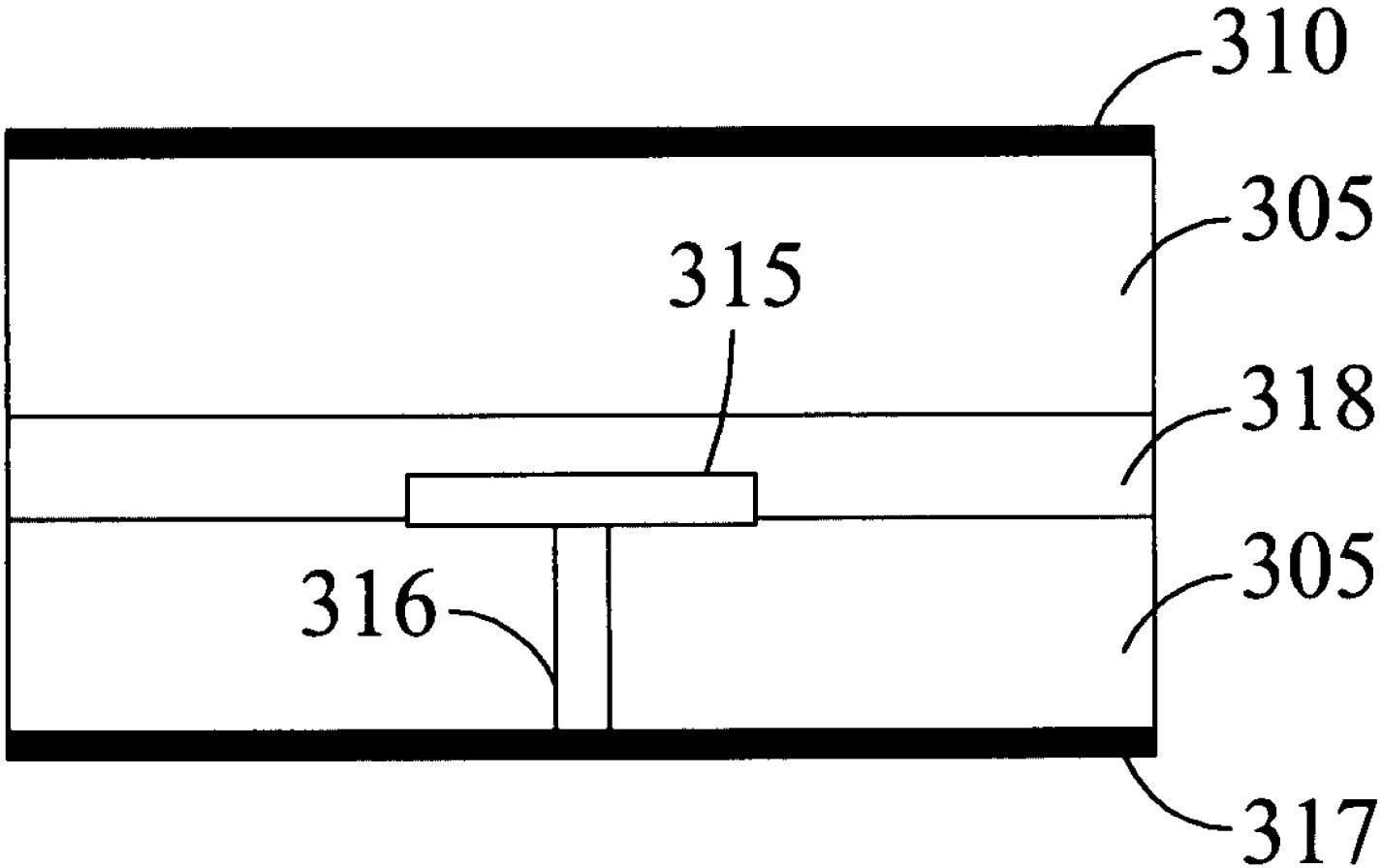
FIG. 3-*a* is a cross-section diagram of a mushroom in the tri-frequency duplexer circuit according to the present invention.
Figure 3B:
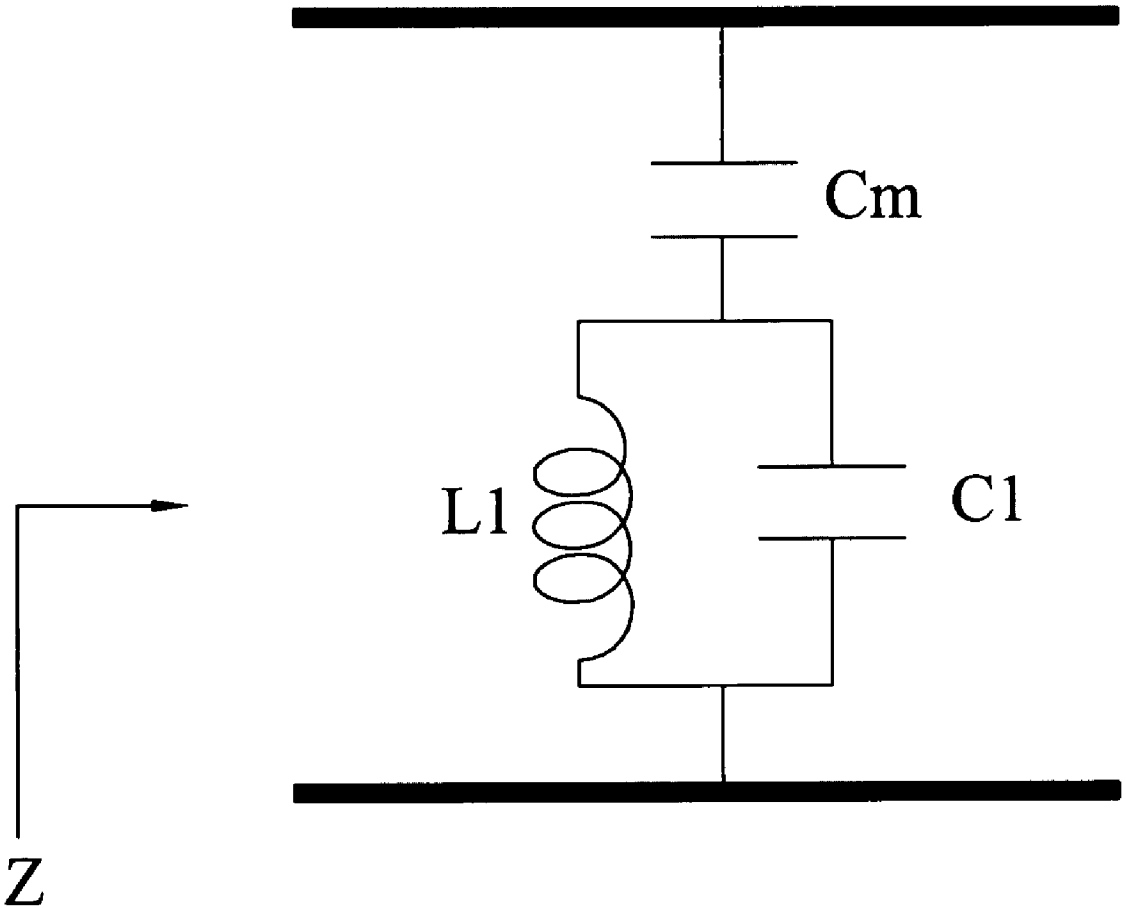
Figure 3C:
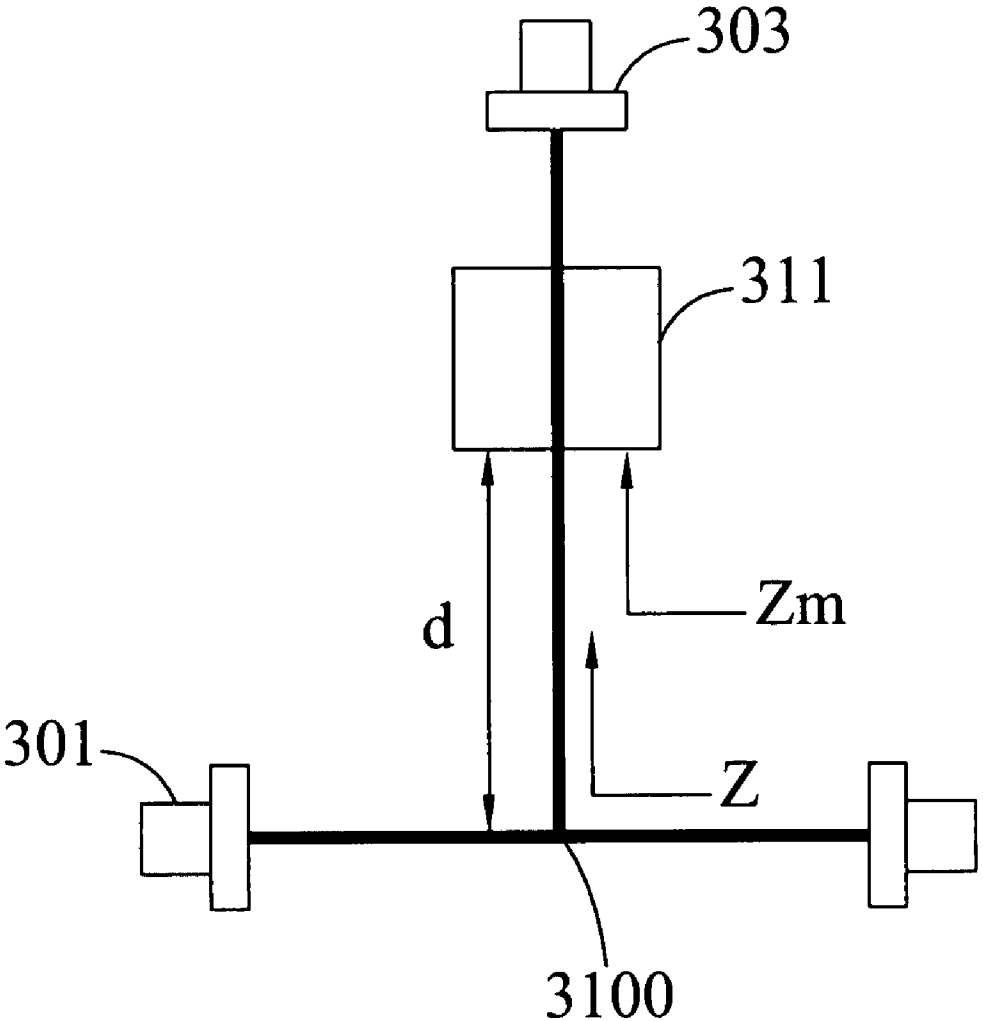

Each of the aforementioned mushrooms may include a meta-material. Refer next to FIG. 3-*a*, wherein a cross-section diagram of a mushroom in the tri-frequency duplexer circuit according to the present invention is shown. In the Figure, the two circuit substrates 305 are preferably the high frequency circuit board of Rogers RT/Duroid 5880, or the FR4 substrate of a copper foil substrate. These two circuit substrates 305 are respectively used as the support board and mushroom board of the transmission line 310, in which the mushroom may comprise a metal plate 315, a metal rod 316 and metal ground 317. An air layer 318 may exist in space supported between the upper and lower circuit boards 305 by a plastic gasket.

Refer now to FIG. 3-*b*, wherein an effectively equivalent circuit diagram of a mushroom in the tri-frequency duplexer circuit according to the present invention is shown. In the Figure, Cm indicates the capacitance between the transmission line and the metal plate, and the existence of the air layer can indeed increase the capacitance of Cm, allowing greater couple capacity between the transmission line and the metal plate. L1 represents the effectively equivalent inductance of the metal rod. C1 means the capacitance between the metal plate and the metal ground. Under such an effectively equivalent circuit architecture, the mushroom forms a resonance chamber with capacitance and inductance connected in parallel, thus in case the resonance frequency $w=1\sqrt{L1C1}$, the input impedance Z may be considered as an infinitely large effectively equivalent open circuit. When the signal is transferred to the mushroom at this resonance frequency, the signal can not pass through as if encountering an open circuit, which reflects the feature of Electromagnetic Band Gap (EBG) that the mushroom in combination with the suspended microstrip can have, in which such a resonance frequency can be referred as the EBG frequency. Additionally, the mushroom itself presents a feature of reciprocity for circuits, which means the signal transmissions in the mushroom can be bi-directional at the same EBG frequency.

Refer now to FIG. 3-*c*, wherein an impedance diagram in the tri-frequency duplexer circuit according to the present invention in consideration of transmission line effect is shown. As illustrated in the Figure, on the transmission line from the first I/O port 301 to the third I/O port 303 there installs a mushroom 311, the EBG frequency of the mushroom 311 being fm. Upon input of a signal at frequency fm from the first I/O port 301, due to the feature of the transmission line, the input impedance Z viewed by the signal of frequency fm at the joint 3100 toward the third I/O port 303 may not be infinitely large; hence, in order to let the input impedance Z viewed by the signal of frequency fm at the joint 3100 toward the third I/O port 303 be in an infinitely large open circuit state, as the same case for the input impedance Zm viewed by the signal of frequency fm from the mushroom 311, it is possible to, in terms of the EBG frequency of the mushroom 311 and by using Smith Chart, specify the length d of the transmission line between the joint 3100 and the mushroom 311, so as to achieve the impedance matching effect through simple transmission line design. The method for achieving the impedance matching in the transmission line designed as above is well-known by those skilled ones in the art, and details thereof will be herein omitted for brevity.

The impedance matching enabled in the present invention by using the features of the mushroom EBG frequency, reciprocity for circuits and transmission line combined therewith is comprehensive, which allows impedance matching for a first I/O port 201, the second I/O port 202, the third I/O port 203 and a fourth I/O port 204, such that the tri-frequency duplexer circuit 200 is capable of providing both bi-directional communication and frequency classification function at the same time.

Accordingly, upon inputting a signal of the first EBG frequency at the first I/O port 201, the impedance may be infinitely large and considered as an open circuit when the signal of the first EBG frequency viewing at the joint 2100 toward the second I/O port 202 and the third I/O port 203, so the signal of the first EBG frequency may be completely outputted via the fourth I/O port 204; meanwhile, upon inputting a signal of the first EBG frequency at the fourth I/O port 204, the impedance may be also infinitely large when viewed at the joint 2100 toward the second I/O port 202 and the third I/O port 203, so the signal of the first EBG frequency may be completely outputted through the first I/O port 201. Similarly, the signal of the second EBG frequency inputted at the first I/O port 201 will be completely outputted from the third I/O port 203; the signal of the third EBG frequency inputted at the first I/O port 201 will be completely outputted from the second I/O port 202. Again, the signal of the third EBG frequency inputted at the second I/O port 202 will be completely outputted from the first I/O port 201; and the signal of the second EBG frequency inputted at the third I/O port 203 will be completely outputted from the first I/O port 201.

Figure 4:
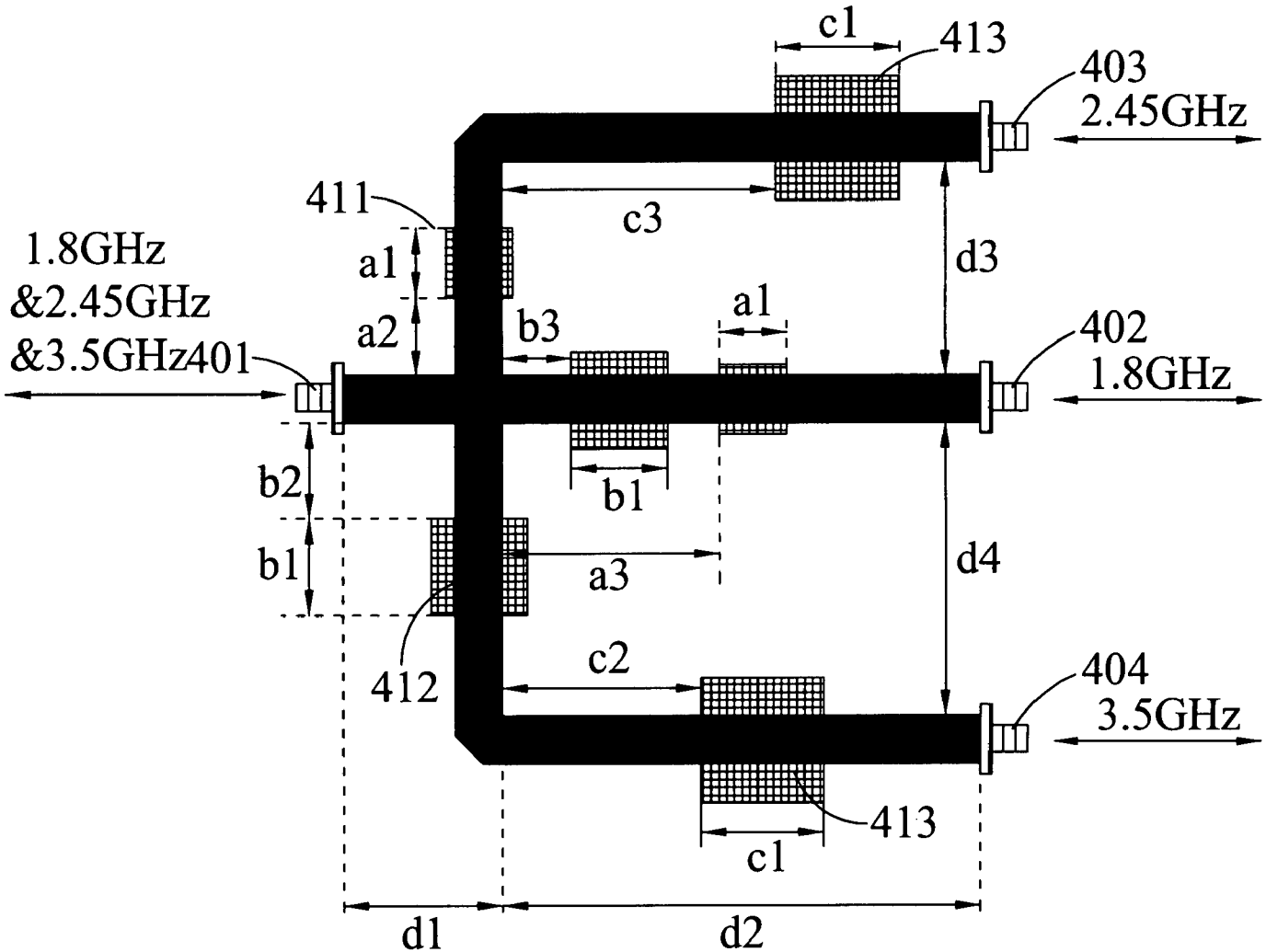
FIG. 4 is a diagram for an embodiment of the tri-frequency duplexer circuit according to the present invention.
Figure 5A:
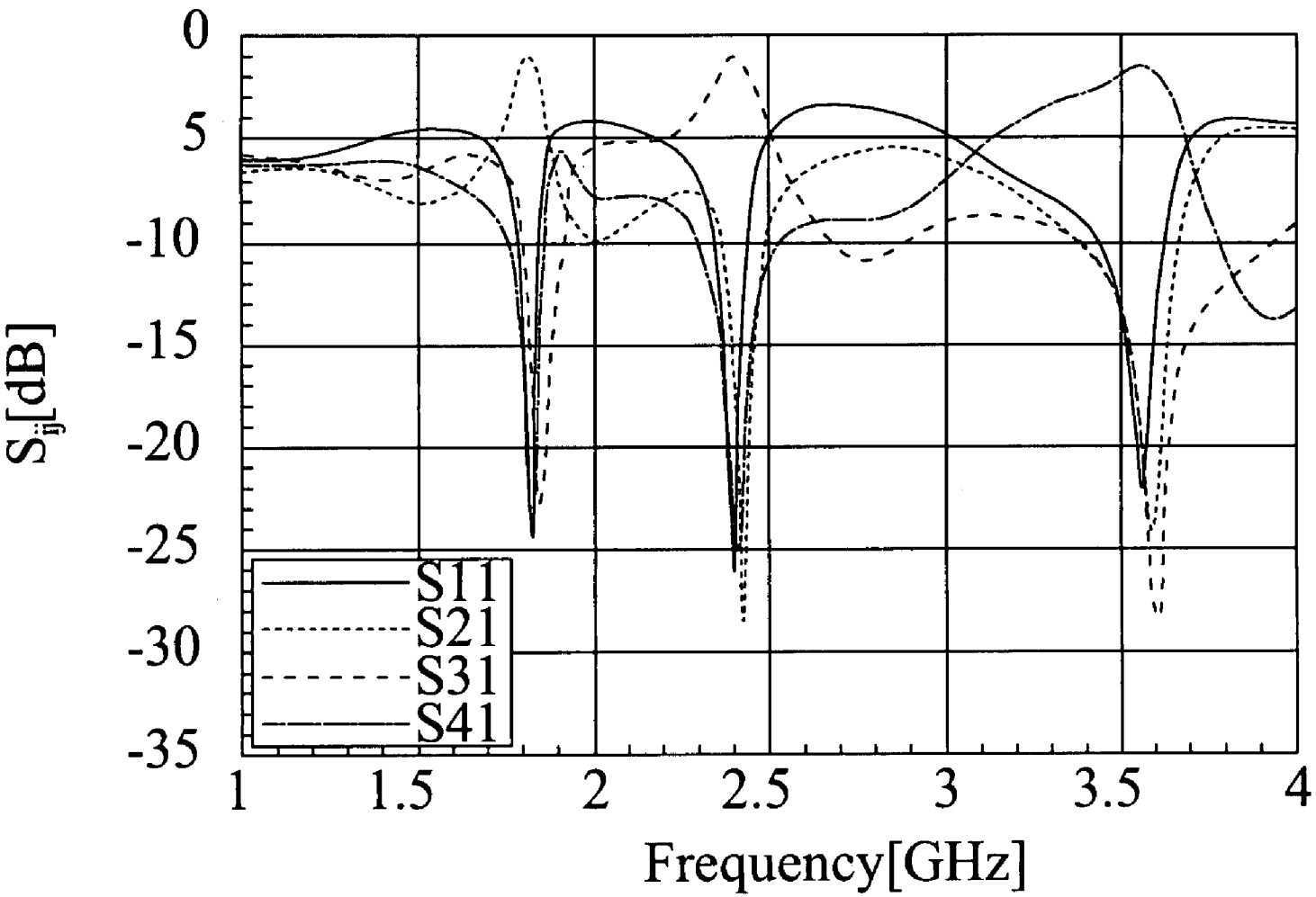
FIG. 5-*a* is a measurement diagram for the S parameter inputted from the first I/O port of the tri-frequency duplexer circuit according to the present invention.
Figure 5B:
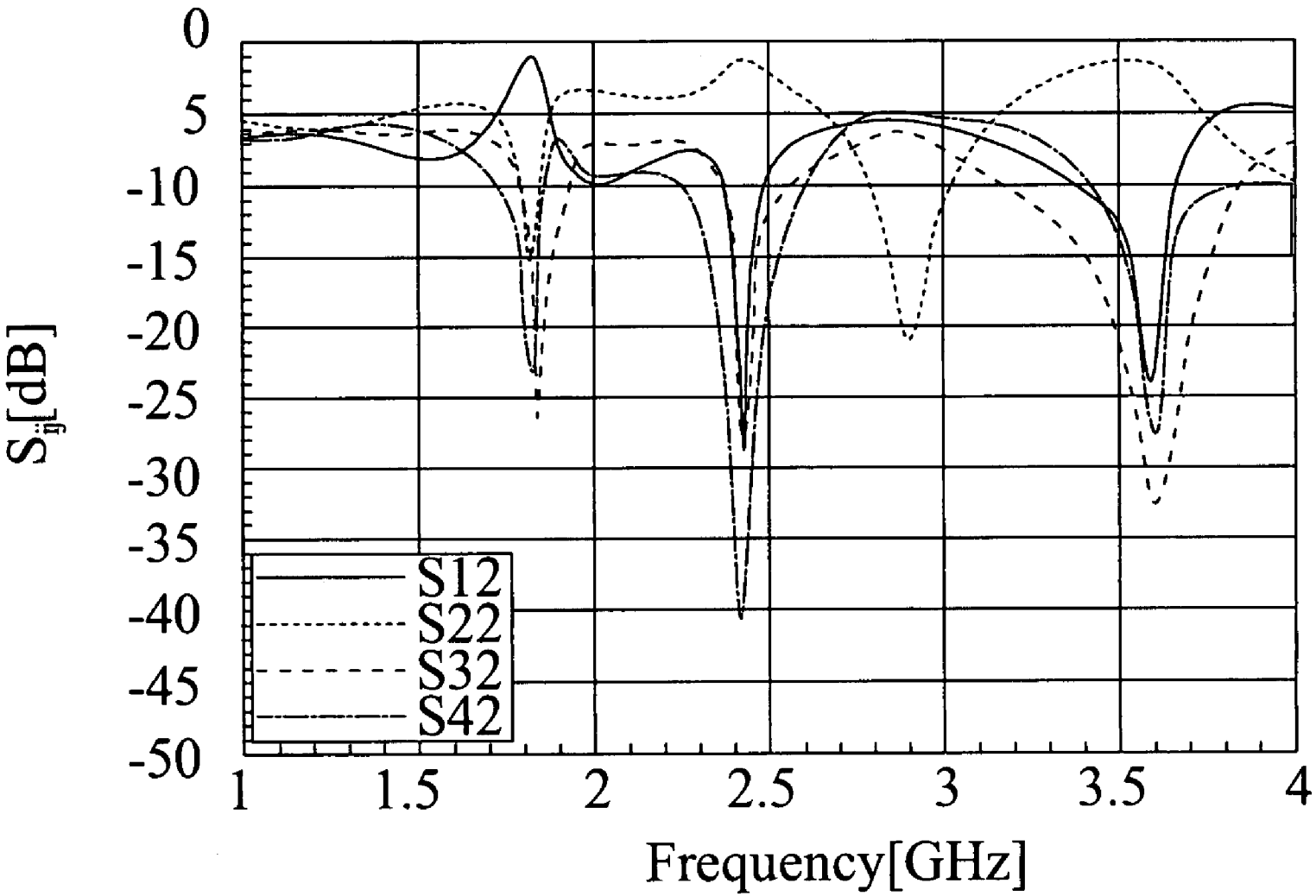
Figure 5C:
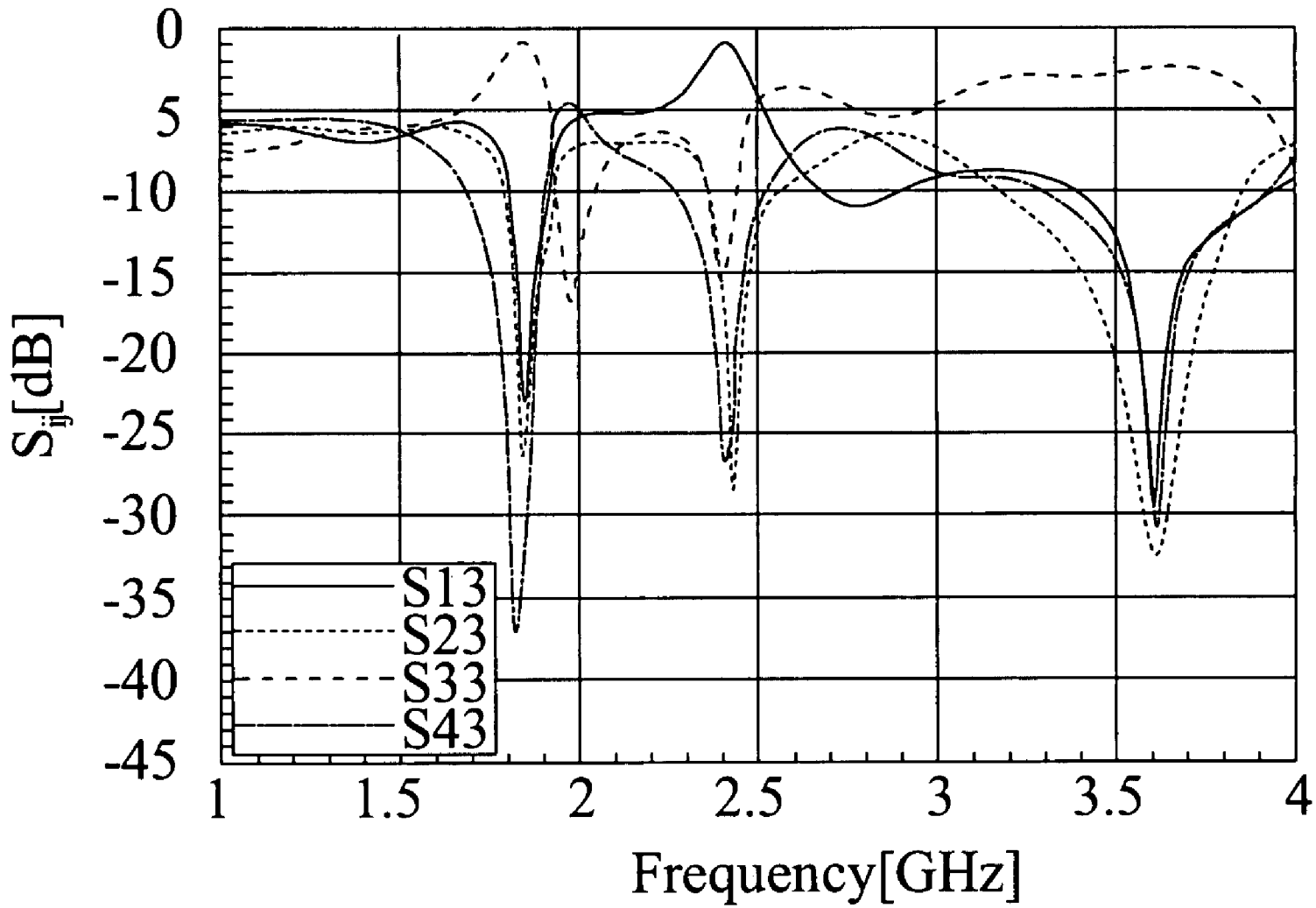
Figure 5D:
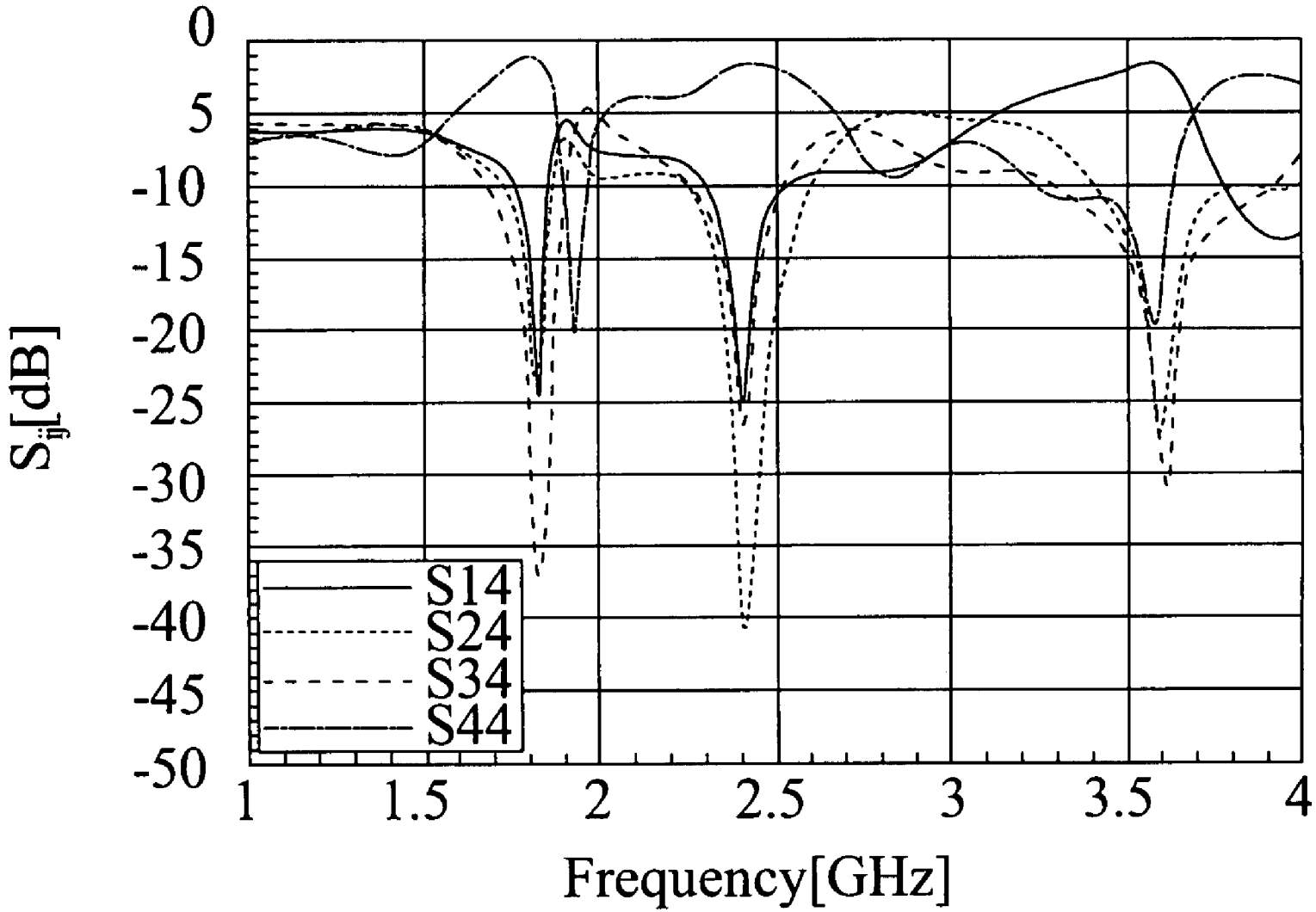

In practice, referring to FIG. 4, it is possible to design a first mushroom 411 whose EBG frequency is WiMAX 3.5 GHz, a second mushroom 412 whose EBG frequency is WiFi 2.45 GHz and a third mushroom 413 whose EBG frequency is GSM 1800 MHz, with length a1 being 12.8 mm, length a2 13.7 mm, length a3 51.9 mm, length b1 17.9 mm, length b2 18 mm, length b3 21.2 mm, length c1 23.2 mm, length c2 37.6 mm, length c3 51.9 mm, length d1 30 mm, length d2 90 mm, length d3 40 mm and length d4 55 mm. Herein, upon inputting a GSM signal at the first I/O port 401, due to the EBG feature at 1800 MHz frequency of the third mushroom 413 between the transmission lines from the first I/O port 401 to the third I/O port 403 and from the first I/O 401 to the fourth I/O port 404, along with the impedance matching in the transmission lines, the GSM signal will be completely outputted through the second I/O port 402; meanwhile, upon inputting a GSM signal at the second I/O port 402, due to the EBG feature of the third mushroom 413 between the transmission lines toward the third I/O port 403 and the fourth I/O port 404, along with the impedance matching in the transmission lines, the GSM signal will be completely outputted through the first I/O port 401. Again, similarly, upon inputting a WiFi signal at the first I/O port 401, the WiFi signal will be completely outputted through the third I/O port 403; upon inputting a WiFi signal at the third I/O port 403, the WiFi signal will be completely outputted through the first I/O port 401. For the same reason, once more, upon inputting a WiMAX signal at the first I/O port 401, the WiMAX signal will be completely outputted through the fourth I/O port 404; while upon inputting a WiMAX signal at the fourth I/O port 404, the WiMAX signal will be completely outputted through the first I/O port 401.

Thus, the tri-frequency duplexer circuit according to the present invention may be disposed at the cross-point of the communication systems having various frequency band specifications as the matching circuit for system integration. For example, in terms of three types of a system like GSM 1800 MHz, WiFi 2.45 GHz and WiMAX 3.5 GHz, it is possible to connect to the integration system of GSM 1800 MHz, WiFi 2.45 GHz and WiMAX 3.5 GHz at the first I/O port 401, to connect to the system of GSM 1800 MHz at the second I/O port 402, to the system of WiFi 2.45 GHz at the third I/O port 403 and to the system of WiMAX 3.5 GHz at the fourth I/O port 404; in this way, such three systems may be successfully provided with mutual data transmission functions among them. Same circuit concept may also be applied in other different communication specifications, or it is even possible to extend such a concept to even more frequencies.

Refer now to FIG. 5-*a*, wherein a measurement diagram for the S parameter inputted from the first I/O port of the tri-frequency duplexer circuit according to the present invention is shown. Herein FIGS. 5-*a* to 5-*d* illustrate the measurements on the circuit shown in FIG. 4. In the Figure, the reflection coefficients 511 for GSM 1800 MHz, WiFi 2.45 GHz and WiMAX 3.5 GHz are small, indicating the signal of GSM 1800 MHz, WiFi 2.45 GHz and WiMAX 3.5 GHz, at the first I/O port may be completely inputted. The penetration coefficient S21 is large for GSM 1800 MHz, meaning GSM 1800 MHz may be completely outputted from the second I/O port. The penetration coefficient S31 is large for WiFi 2.45 GHz, that is, WiFi 2.45 GHz may be completely outputted from the third I/O port. The penetration coefficient S41 is large for WiMAX 3.5 GHz, indicating that WiMAX 3.5 GHz may be completely outputted from the fourth I/O port. As such a result, it illustrates that the tri-frequency duplexer circuit according to the present invention provides the frequency classification function of the triplexer.

Refer to FIG. 5-*b*, wherein a measurement diagram for the S parameter inputted from the second I/O port of the tri-frequency duplexer circuit according to the present invention is shown. In the Figure, it may be seen that, as inputting the GSM 1800 MHz signal at the second I/O port, S12 is large at 1800 MHz, indicating the GSM signal may be completely outputted via the first I/O port.

Refer next to FIG. 5-*c*, wherein a measurement diagram for the S parameter inputted from the third I/O port of the tri-frequency duplexer circuit according to the present invention is shown. In the Figure, it may be seen that, as inputting the WiFi 2.45 GHz signal at the third I/O port, S13 is large at 2.45 GHz, indicating the WiFi signal may be completely outputted via the first I/O port.

Refer further to FIG. 5-*d*, wherein a measurement diagram for the S parameter inputted from the fourth I/O port of the tri-frequency duplexer circuit according to the present invention is shown. In the Figure, it may be seen that, as inputting the WiMAX 3.5 GHz signal at the fourth I/O port, S14 is large at 3.5 GHz, indicating the WiMAX signal may be completely outputted via the first I/O port. From FIGS. 5-*b* to 5-*d*, it clearly demonstrates that the tri-frequency duplexer circuit according to the present invention indeed provides the bi-directional communication of the duplexer.

Figure 6:
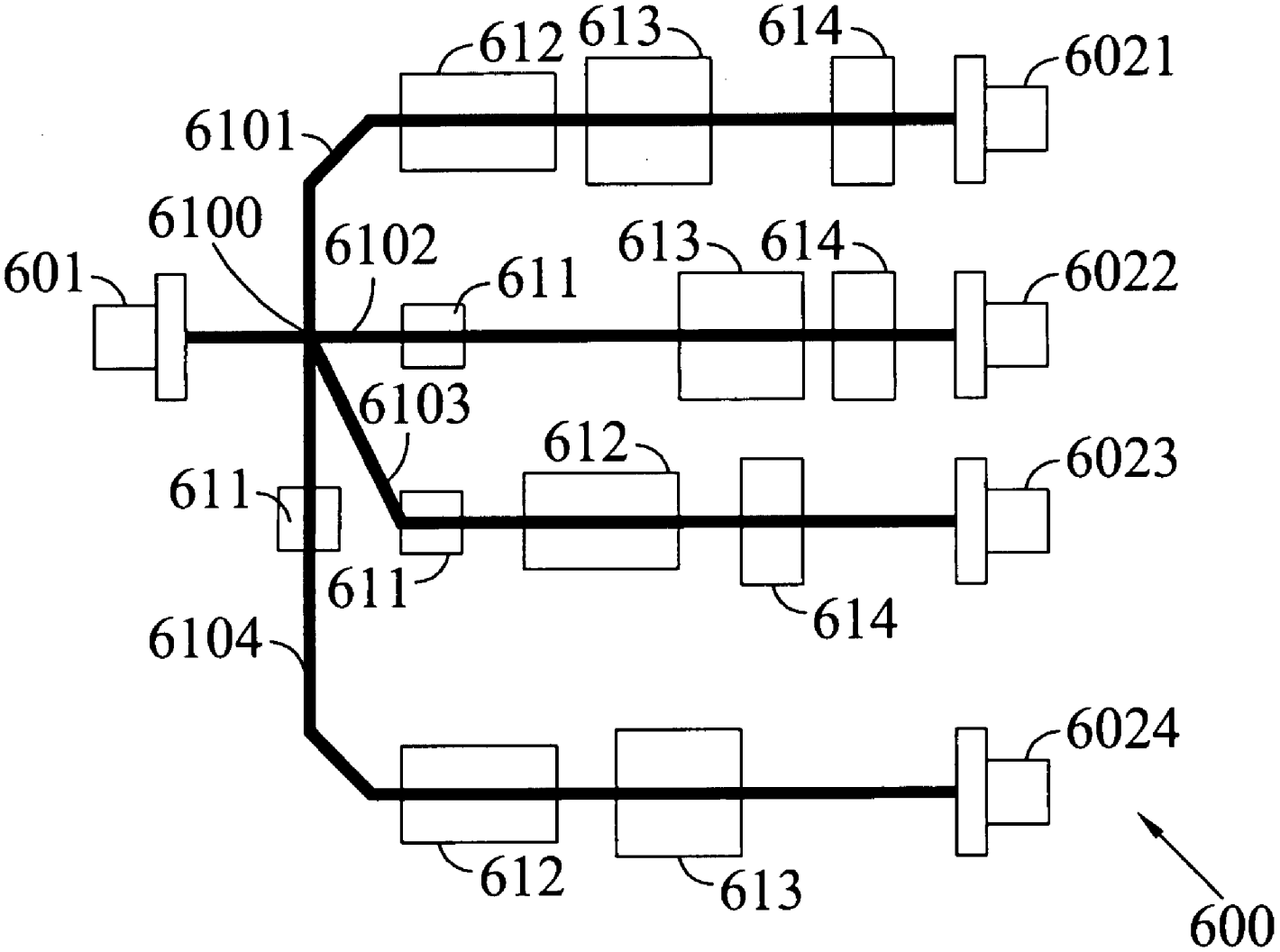
FIG. 6 is a diagram of a multi-frequency duplexer circuit according to the present invention.

Refer to FIG. 6, wherein a diagram of a multi-frequency duplexer circuit according to the present invention is shown. Herein it takes a quadri-frequency duplexer as an example. The differences between the quadri-frequency duplexer circuit 600 and the tri-frequency duplexer circuit lie in that one more transmission line is added to the microstrip line circuit, and one more mushroom is placed on each of the transmission lines. Thus, the quadri-frequency duplexer circuit may provide the bi-directional communication and the frequency classification function at the same time by using the features of EBG in three mushrooms disposed on each of the transmission line paths, reciprocity for circuits and impedance matching in the transmission lines combined therewith, allowing the communication specifications of four frequency bands to perform data transmission among them.

In this Figure, it takes four frequencies as an embodiment for the multi-frequency duplexer circuit, in which the quadri-frequency duplexer circuit 600 comprises a microstrip line circuit, a first mushroom set, a second mushroom set, a third mushroom set and a fourth mushroom set.

The microstrip line circuit comprises a first I/O port 601, a second I/O port (#1) 6021, a second I/O port (#2) 6022, a second I/O port (#3) 6023, a second I/O port (#4) 6024, a first transmission line path 6101, a second transmission line path 6102, a third transmission line path 6103 and a fourth transmission line path 6104.

These four transmission line paths are respectively connected to the first I/O port 601 and four second I/O ports, in which the second I/O port (#1) 6021 may output a signal of a frequency within a first frequency band, the second I/O port (#2) 6022 may output a signal of a frequency within a second frequency band, the second I/O port (#3) 6023 may output a signal of a frequency within a third frequency band and the second I/O port (#4) 6024 may output a signal of a frequency within a fourth frequency band.

The first mushroom set comprises three mushrooms 611, respectively placed at the transmission line paths except the first transmission line path 6101, and the EBG frequency of the three mushrooms 611 in the first mushroom set corresponds to the first frequency band.

The second mushroom set comprises three mushrooms 612, respectively placed at the transmission line paths except the second transmission line path 6102, and the EBG frequency of the three mushrooms 612 in the second mushroom set corresponds to the second frequency band.

The third mushroom set comprises three mushrooms 613, respectively placed at the transmission line paths except the third transmission line path 6103, and the EBG frequency of the three mushrooms 613 in the third mushroom set corresponds to the third frequency band.

The fourth mushroom set comprises three mushrooms 614, respectively placed at the transmission line paths except the fourth transmission line path 6104, and the EBG frequency of the three mushrooms 614 in the fourth mushroom set corresponds to the fourth frequency band.

In terms of different EBG frequencies of the first mushroom set, the second mushroom set, the third mushroom set and the fourth mushroom set, it is possible, by using Smith Chart, to respectively design the transmission line lengths between each mushroom within these first mushroom set, second mushroom set, third mushroom set and fourth mushroom set and the joint 6100, so as to achieve the effect of appropriate impedance matching.

Accordingly, upon inputting a signal of the first frequency band at the first I/O port 601, the signal of the first frequency band will be completely outputted through the second I/O port (#1) 6021. Upon inputting a signal of the first frequency band at the second I/O port (#1) 6021, the signal of the first frequency band will be completely outputted through the first I/O port 601. A signal of the second frequency band inputted at the first I/O port 601 will be completely outputted via the second I/O port (#2) 6022. A signal of the third frequency band inputted at the first I/O port 601 will be completely outputted through the second I/O port (#3) 6023. Similarly, a signal of the fourth frequency band inputted at the first I/O port 601 will be completely outputted from the second I/O port (#4) 6024.

Conversely, a signal of the second frequency band inputted at the second I/O port (#2) 6022 will be completely outputted from the first I/O port 601. A signal of the third frequency band inputted at the second I/O port (#3) 6023 will be completely outputted from the first I/O port 601. A signal of the fourth frequency band inputted at the second I/O port (#4) 6024 will be completely outputted by way of the first I/O port 601.

The present invention is by no means limited to the illustrated tri-frequency or quadri-frequency duplexer circuit, but the same circuit concept may be widely extended to multi-frequency duplexer circuits, enabling bi-directional communication and frequency classification function at the same time. For example, an N-frequency duplexer circuit may perform multi-frequency band operations in N frequency bands, where N being an integer greater than 1. Such an N-frequency duplexer circuit may comprise a microstrip line circuit and N mushroom sets. The microstrip may comprise a first I/O port, N second I/O ports and N transmission line paths, and the N transmission line paths are respectively connected to the first I/O port and N second I/O ports, in which the Mth second I/O port is allowed to input/output a signal within the Mth frequency band, where M being an integer between 1 and N.

Each mushroom set comprises N−1 mushrooms, and the mushrooms in the Nth mushroom set may respectively correspond to the N frequency bands. Herein the mushrooms in the Mth mushroom set may be respectively disposed at the transmission line paths with an exception of the Mth transmission line path.

The descriptions illustrated hereinbefore are exemplary, but not restrictive. All effectively equivalent modifications or changes made without departing from the spirit and scope of the present invention are to be deemed as being encompassed by the claims appended hereunder.

What is claimed is:

1. A tri-frequency duplexer circuit, comprising:

a microstrip line circuit, comprising a first Input/Output (I/O) port, a second I/O port, a third I/O port and a fourth I/O port;

two first mushrooms with a first Electromagnetic Band Gap (EBG) frequency, respectively disposed at a transmission line path between the first I/O port and the second I/O port and a transmission line path between the first I/O port and the third I/O port;

two second mushrooms with a second EBG frequency, respectively disposed at the transmission line path between the first I/O port and the second I/O port and a transmission line path between the first I/O port and the fourth I/O port;

two third mushrooms with a third EBG frequency, respectively disposed at the transmission line path between the first I/O port and the third I/O port and the transmission line path between the first I/O port and the fourth I/O port; and a first substrate and a second substrate with an air layer being defined between the first substrate and the second substrate, the microstrip line circuit being disposed on the first substrate, and the two first mushrooms, the two second mushrooms and the two third mushrooms being disposed within the second substrate;

wherein the first EBG frequency, the second EBG frequency, and the third EBG frequency differ from each other.

2. The tri-frequency duplexer circuit according to claim 1, wherein the two first mushrooms, the two second mushrooms and the two third mushrooms respectively comprise a metal plate, a metal rod and a metal ground, the metal plate and the metal ground are disposed correspondingly on two surface of the second substrate, the metal rod is connected between the metal plate and the metal ground, and the metal plate is arranged to be exposed to the air layer.

3. The tri-frequency duplexer circuit according to claim 2, wherein the shape of the metal plate is square, triangular, circular or any geometric shape.

4. The tri-frequency duplexer circuit according to claim 2, wherein the shape of the metal rod is square, triangular, circular or any geometric shape.

5. The tri-frequency duplexer circuit according to claim 2, wherein the size of the metal plate or the metal rod determines the first EBG frequency, the second EBG frequency and the third EBG frequency of the mushrooms.

6. The tri-frequency duplexer circuit according to claim 1, wherein the microstrip line circuit further comprises a joint, and the length of the transmission line from the first mushrooms, the second mushrooms or the third mushrooms to the joint is specified achieve to impedance matching.

7. A multi-frequency duplexer circuit applicable for multi-frequency operations in N frequency bands, N being an integer greater than 1, the multi-frequency duplexer circuit comprising:

a microstrip line circuit, comprising a first Input/Output (I/O) port, N second I/O ports and N transmission line paths, the N transmission line paths being respectively connected to the first I/O port and the N second I/O ports, wherein an Mth second I/O port is used to input/output a signal of a frequency located within an Mth frequency band, M being an integer between 1 and N;

N mushroom sets, being disposed at the N transmission lines paths between the first I/O port and the N second I/O ports, each mushroom set comprising N−1 mushrooms, and Electromagnetic Band Gap (EBG) frequencies of the mushrooms in the N mushroom sets respectively corresponding to the N frequency bands; and a first substrate and a second substrate with an air layer being defined between the first substrate and the second substrate, the N transmission line paths being disposed on the first substrate, and the mushrooms in the N mushroom sets being disposed within the second substrate;

wherein the Mth mushroom set are disposed at a transmission line path between the first I/O port and the Mth second I/O port, and wherein the mushrooms of an Mth mushroom set are respectively disposed at the transmission line paths with an exception of an Mth transmission line path;

wherein the N frequency bands differ from each other.

8. The multi-frequency duplexer circuit according to claim 7, wherein the mushrooms in the N mushroom sets respectively comprise a metal plate, a metal rod and a metal ground, the metal plate and the metal ground are disposed correspondingly on two surface of the second substrate, the metal rod is connected between the metal plate and the metal ground, and the metal plate is arranged to be exposed to the air layer.

9. The tri-frequency duplexer circuit according to claim 8, wherein the shape of the metal plate is square, triangular, circular or any geometric shape.

10. The multi-frequency duplexer circuit according to claim 8, wherein the shape of the metal rod is square, triangular, circular or any geometric shape.

11. The multi-frequency duplexer circuit according to claim 8, wherein the size of the metal plate or the metal rod determines EBG frequencies of the mushrooms.

12. The multi-frequency duplexer circuit according to claim 7, wherein the microstrip line circuit further comprises a joint, and the length of the transmission line from each of the mushrooms to the joint is specified achieve impedance matching.

* * * * *